US010128033B2

(12) United States Patent
Yen et al.

(10) Patent No.: US 10,128,033 B2
(45) Date of Patent: Nov. 13, 2018

(54) INDUCTOR DEVICE

(71) Applicant: Realtek Semiconductor Corporation, Hsinchu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 13 days.

(21) Appl. No.: 15/016,287

(22) Filed: Feb. 5, 2016

(65) Prior Publication Data

US 2016/0343502 A1 Nov. 24, 2016

(30) Foreign Application Priority Data

May 20, 2015 (TW) ..... 104116110 A

(51) Int. Cl.
*H01F 21/12* (2006.01)
*H01F 17/00* (2006.01)
*H01F 29/02* (2006.01)

(52) U.S. Cl.
CPC ..... *H01F 21/12* (2013.01); *H01F 2017/0073* (2013.01)

(58) Field of Classification Search
CPC ..... H01F 29/02; H01F 21/12; H01F 2021/125
See application file for complete search history.

(56) References Cited

U.S. PATENT DOCUMENTS 6,891,444 B2 * 5/2005 Jacobsson ..... H03B 5/1231 331/108 B
7,154,349 B2 12/2006 Cabanillas
7,629,859 B2 * 12/2009 Rai ..... H03B 5/1847 331/117 R
8,018,312 B2 * 9/2011 Kossel ..... H03H 7/185 331/117 R
8,183,971 B2 5/2012 Le Guillou et al.
2005/0195063 A1 * 9/2005 Mattsson ..... H01F 27/346 336/225
2005/0231303 A1 * 10/2005 Chang ..... H01F 21/12 333/174
2006/0033602 A1 * 2/2006 Mattsson ..... H01F 17/0006 336/200
2008/0084255 A1 * 4/2008 El Rai ..... H01F 17/0006 333/185
2009/0289727 A1 * 11/2009 El Rai ..... H03B 5/1847 331/46

(Continued)

FOREIGN PATENT DOCUMENTS

CN 102306642 A * 1/2012 ..... H01F 29/02
CN 102306642 A 1/2012
TW 200535878 A 11/2005

*Primary Examiner* — Elvin G Enad
*Assistant Examiner* — Malcolm Barnes
(74) *Attorney, Agent, or Firm* — CKC & Partners Co., Ltd.

(57) ABSTRACT

An inductor device includes a conductor and a connector. The conductor includes a first ring-type structure and a second ring-type structure. The second ring-type structure is coupled to the first ring-type structure. The connector is coupled to the first ring-type structure and the second ring-type structure, and is configured to selectively connect the first ring-type structure and the second ring-type structure such that the conductor forms single loop.

15 Claims, 8 Drawing Sheets

(56) References Cited

U.S. PATENT DOCUMENTS

| | | | | |
|---|---|---|---|---|
| 2011/0032067 | A1* | 2/2011 | Le Guillou | H01F 17/0006 336/200 |
| 2011/0102093 | A1* | 5/2011 | El Rai | H03B 5/1841 331/117 FE |
| 2012/0154073 | A1* | 6/2012 | Lee | H01F 21/12 333/174 |
| 2012/0244802 | A1* | 9/2012 | Feng | H04B 5/0087 455/41.1 |
| 2013/0141203 | A1* | 6/2013 | Yoon | H01L 23/5227 336/170 |
| 2014/0167867 | A1* | 6/2014 | Ahmed | H01F 29/00 331/117 R |
| 2014/0357208 | A1* | 12/2014 | Tsai | H03H 7/48 455/127.3 |
| 2015/0065068 | A1* | 3/2015 | Mattsson | H01F 17/0006 455/90.2 |

* cited by examiner

INDUCTOR DEVICE

RELATED APPLICATIONS

This application claims priority to Taiwanese Application Serial Number 104116110, filed May 20, 2015, which is herein incorporated by reference.

BACKGROUND

Field of Invention

The present invention relates to devices. More particularly, the present invention relates to an inductor device.

Description of Related Art

The various inductors nowadays have advantages and disadvantages. For instance, spiral type inductors have the best Q value and large mutual inductance if it is designed correctly. However, the mutual inductance and the coupling condition of the spiral type inductors occurs amongst its coils. When it comes to 8-shaped inductors, since magnetic orientations of two coils of an 8-shaped inductor are opposite, the mutual inductance and the coupling condition occur at another coil of the 8-shaped inductor. Furthermore, 8-shaped inductors occupy more space in a device other than other types of inductors.

In view of the foregoing, problems and disadvantages are associated with existing products that require further improvement. However, those skilled in the art have yet to find a solution.

SUMMARY

The following presents a simplified summary of the disclosure in order to provide a basic understanding to the reader. This summary is not an extensive overview of the disclosure and it does not identify key/critical elements of the present invention or delineate the scope of the present invention.

One aspect of the present disclosure is directed to an inductor device. The inductor device comprises a conductor and a connector. The conductor comprises a first ring-type structure and a second ring-type structure. The second ring-type structure is coupled to the first ring-type structure. The connector is coupled to the first ring-type structure and the second ring-type structure, and selectively connects the first ring-type structure and the second ring-type structure such that the conductor forms single loop.

In view of the foregoing, embodiments of the present disclosure provide an inductor device to generate various inductances such that the serviceable range of the inductor device can be expanded.

These and other features, aspects, and advantages of the present invention, as well as the technical means and embodiments employed by the present invention, will become better understood with reference to the following description in connection with the accompanying drawings and appended claims.

BRIEF DESCRIPTION OF THE DRAWINGS

The invention can be more fully understood by reading the following detailed description of the embodiment, with reference made to the accompanying drawings as follows.

Figure 1:
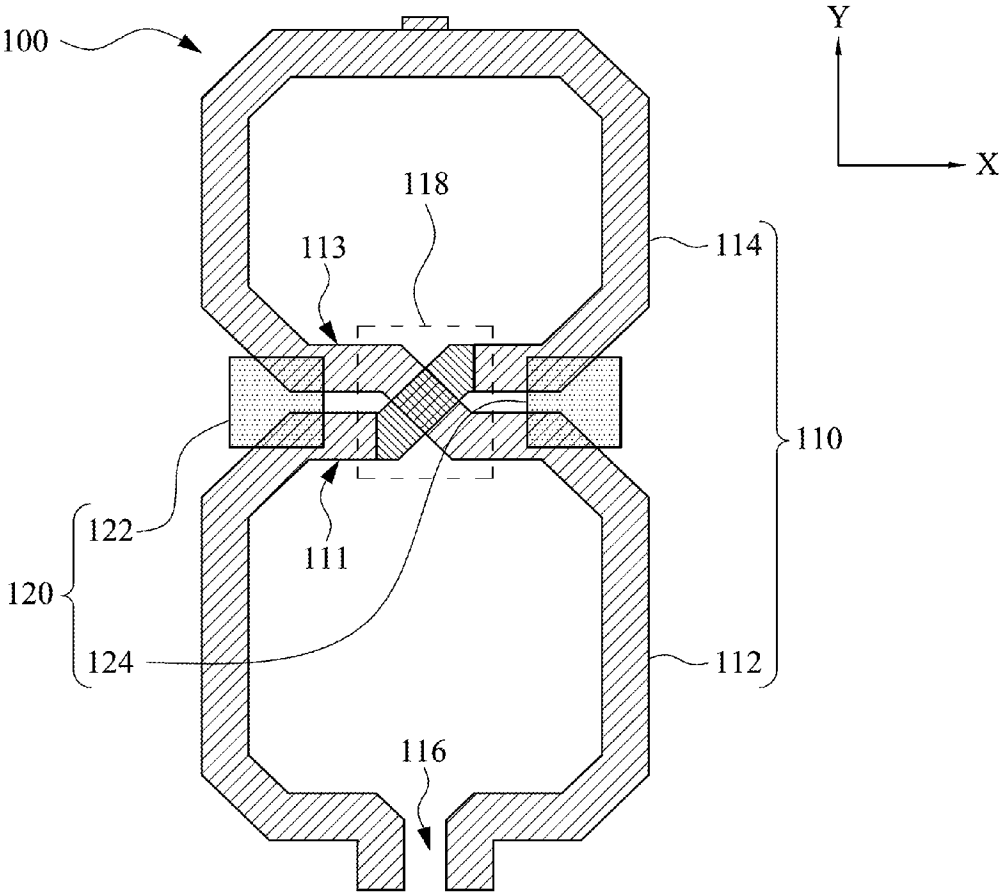
FIG. 1 is a schematic diagram of an inductor device according to embodiments of the present invention.

In accordance with common practice, the various described features/elements are not drawn to scale but instead are drawn to best illustrate specific features/elements relevant to the present invention. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include singular forms of the same.

FIG. 1 is a schematic diagram of an inductor device according to embodiments of the present invention. As shown in the figure, the inductor device 100 comprises a conductor 110 and a connector 120. The conductor 110 comprises a first ring-type structure 112 and a second ring-type structure 114. The second ring-type structure 114 is coupled to the first ring-type structure 112 in an interlaced manner. For example, the conductor 110 can be an 8-shaped inductor. In addition, the connector 120 is coupled to the first ring-type structure 112 and the second ring-type structure 114, and selectively connects the first ring-type structure 112 and the second ring-type structure 114 such that the conductor 110 forms single loop.

Figure 2:
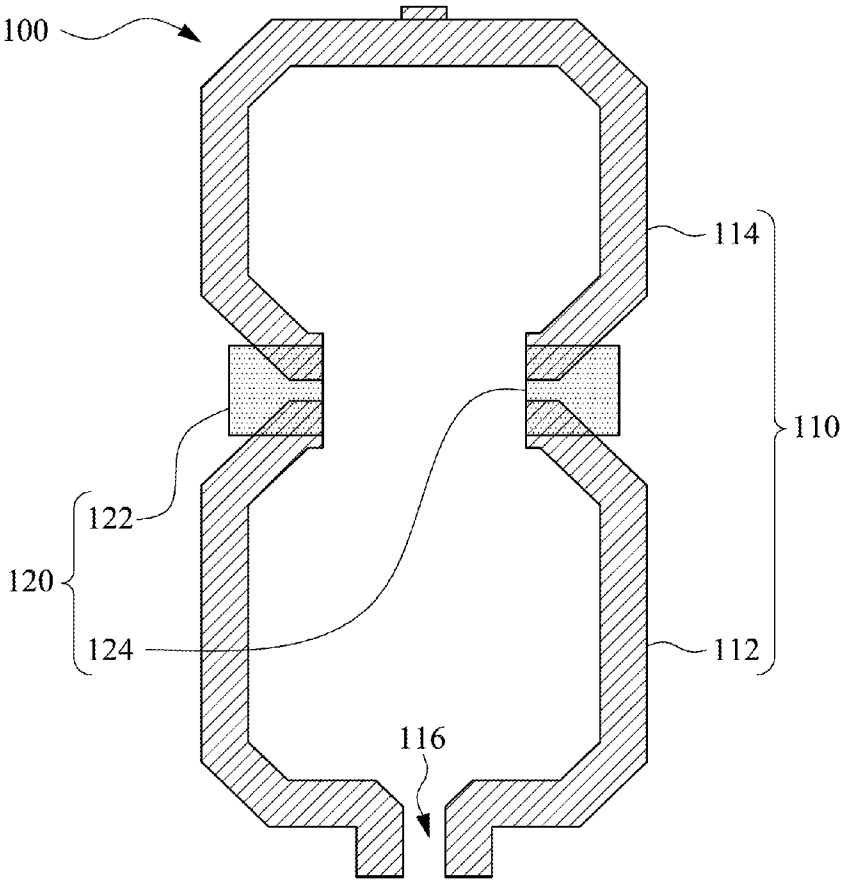
FIG. 2 is a schematic operational diagram of the inductor device as shown in FIG. 1 according to embodiments of the present invention.

For facilitating understanding of the meaning "the conductor 110 forming single loop," reference is now made to both FIG. 1 and FIG. 2. FIG. 2 is a schematic operational diagram of the inductor device as shown in FIG. 1 according to embodiments of the present invention. As shown in the figure, if the connector 120 connects the first ring-type structure 112 and the second ring-type structure 114, the conductor 110 forms single loop as shown in FIG. 2. Explained in another way, the conductor 110 will become a ring-type inductor. In view of the above, the inductor device 100 of embodiment of the present disclosure employs the connector 120 for selectively connecting the first ring-type structure 112 and the second ring-type structure 114 such that the inductor device 100 forms an 8-shaped inductor or a ring-type inductor correspondingly. In addition, since the inductance of the inductor device 100 being an 8-shaped inductor is different from that of the inductor device 100 being a ring-type inductor, the inductor device 100 is capable of providing various inductances such that the serviceable range of the inductor device 100 can be expanded.

In one embodiment, the first ring-type structure 112 comprises an opening 116. The opening 116 is disposed in a direction, and the first ring-type structure 112 and the second ring-type structure 114 are also disposed in the direction. For example, the opening 116, the first ring-type structure 112, and the second ring-type structure 114 are all disposed in Y direction. On the other hand, the opening 116 can be disposed at the bottom of the 8-shaped inductor as shown in FIG. 1. However, the present disclosure is not limited to the embodiment as shown in FIG. 1, the person skilled in the art can arrange the position of the opening 116 depending on actual requirements, such as disposing the opening 116 at the top of the 8-shaped inductor or other proper location.

In another embodiment, the first ring-type structure 112 and the second ring-type structure 114 are disposed in an interlaced manner at a crossing point 118. The connector 120 comprises a first switch 122 and a second switch 124. The first switch 122 is coupled to the first ring-type structure 112 and the second ring-type structure 114, and disposed at one side of the crossing point 118. For example, the first switch 122 can be disposed at left side of the crossing point 118. In addition, the second switch 124 is coupled to the first ring-type structure 112 and the second ring-type structure 124, and disposed at another side of the crossing point 118. For example, the second switch 124 can be disposed at right side of the crossing point 118.

In still another embodiment, the first ring-type structure 112 and the second ring-type structure 114 respectively comprise a first polygonal structure and a second polygonal structure. For example, the first ring-type structure 112 and the second ring-type structure 114 can be octagonal structures. However, the present disclosure is not intended to be limited to this regard, the first ring-type structure 112 and the second ring-type structure 114 can be selectively implemented in other polygon, such as quadrangle, hexagon, and so on, depending on actual requirements. A first edge 111 of a first polygonal structure of the first ring-type structure 112 is adjacent to a second edge 113 of a second polygonal structure of the second ring-type structure 114. The first switch 122 is coupled to one side of the first edge 111 and one side of the second edge 113. The second switch 124 is coupled to another side of the first edge 111 and another side of the second edge 113. For example, the first switch 122 is coupled to left side of the first edge 111 and left side of the second edge 113, and the second switch 124 is coupled to right side of the first edge 111 and right side of the second edge 113.

Figure 3:
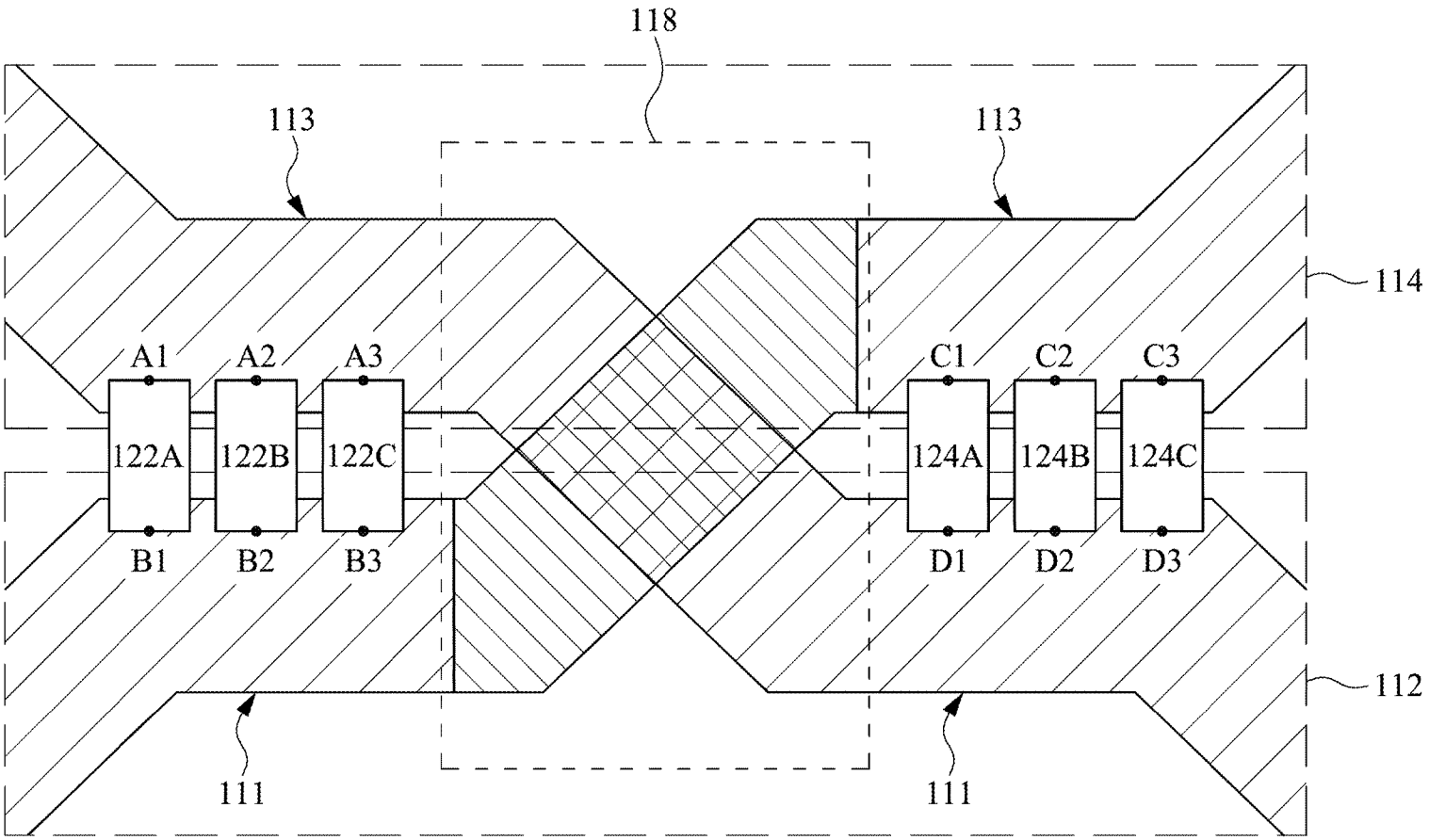
FIG. 3 is a partial structure diagram of the inductor device as shown in FIG. 1 according to embodiments of the present invention.

Referring to FIG. 3, the figure is an enlarged diagram of a connection portion of the first ring-type structure 112, the second ring-type structure 114, and the connector 120 of the inductor device 100 as shown in FIG. 1. As shown in the figure, the marks 122A, 122B, 122C at the left side are positions where the first switch 122 can be disposed. In addition, the crossing point 118 is located at the center of the first edge 111 and the center of the second edge 113. The first switch 122 comprises a first terminal and a second terminal. For example, the first terminal can be the upper terminal of the first switch 122, and the second terminal can be the lower terminal of the first switch 122. The first terminal is coupled to a point between one side of the second edge 113 (i.e., left side) to the center of the second edge 113. For example, the first terminal of the first switch 122 can be coupled to A1 point, A2 point, or A3 point. The second terminal is coupled to a point between one side of the first edge 111 (i.e., left side) to the center of the first edge 111. For example, the second terminal of the first switch 122 can be coupled to B1 point, B2 point, or B3 point. In other words, the first switch 122 can be disposed at positions 122A, 122B, or 122C as shown in FIG. 3.

In another embodiment, the marks 124A, 124B, 124C at the right side of the FIG. 3 are positions where the second switch 124 can be disposed. The second switch 124 comprises a first terminal and a second terminal. For example, the first terminal can be the upper terminal of the second switch 124, and the second terminal can be the lower terminal of the second switch 124. The first terminal is coupled to a point between another side of the second edge 113 (i.e., right side) to the center of the second edge 113. For example, the first terminal of the second switch 124 can be coupled to C1 point, C2 point, or C3 point. The second terminal is coupled to a point between another side of the first edge 111 (i.e., right side) to the center of the first edge 111. For example, the second terminal of the second switch 124 can be coupled to D1 point, D2 point, or D3 point. In other words, the second switch 124 can be disposed at positions 124A, 124B, or 124C as shown in FIG. 3. However, the present disclosure is not limited to the embodiment of FIG. 3, the embodiment is merely used for explanation. The person skilled in the art can arrange the position of the first switch 122 and the second switch 124 depending on actual requirements.

Figure 4:
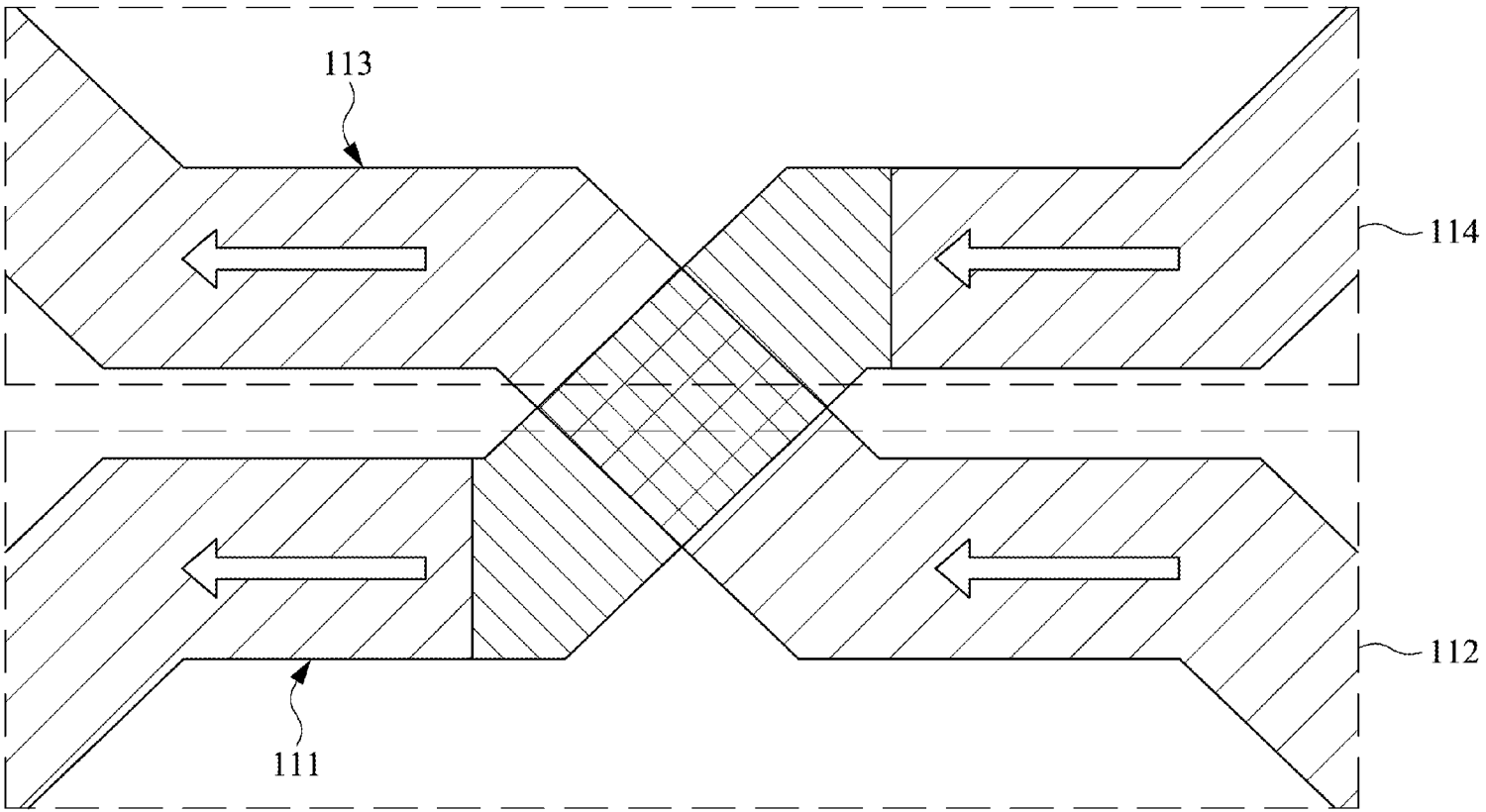
FIG. 4 is an operational diagram of the partial structure of the inductor device as shown in FIG. 3 according to embodiments of the present invention.
Figure 5:
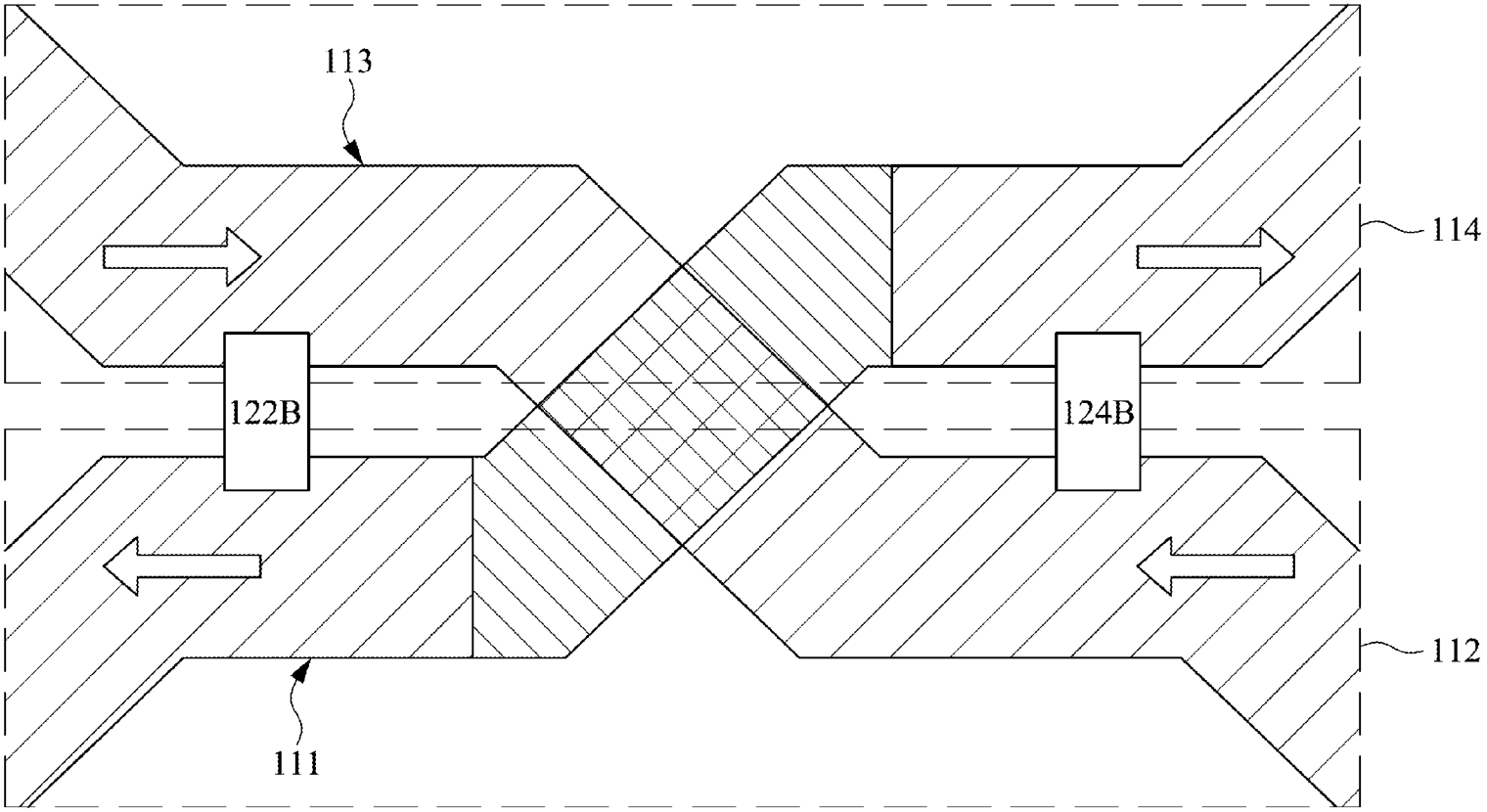
FIG. 5 is an operational diagram of the partial structure of the inductor device as shown in FIG. 3 according to embodiments of the present invention.

FIG. 4 is an operational diagram of the partial structure of the inductor device as shown in FIG. 3 according to embodiments of the present invention. As shown in the figure, the connector 120 of the inductor device 100 herein is turned off. Therefore, the inductor device 100 becomes an 8-shaped inductor. When the inductor device 100 is an 8-shaped inductor, magnetic fields of two coils of the 8-shaped inductor are coupled to each other, and the mutual inductance is positive. As shown in the figure, the direction of current in the first edge 111 of the first ring-type structure 112 is the same as the direction of current in the second edge 113 of the second ring-type structure 114, and the first edge 111 and the second edge 113 generate positive mutual inductance. FIG. 5 is an operational diagram of the partial structure of the inductor device as shown in FIG. 3 according to embodiments of the present invention. The first switch 122 being disposed at position 122B and the second switch 124 being disposed at position 124B are used as an example herein. The first switch 122 and the second switch 124 of the connector 120 of the inductor device 100 are turned on. Therefore, the current flows from the second edge 113 of the second ring-type structure 114 through the first switch 122 to the first edge 111 of the first ring-type structure 112. Meanwhile, the direction of current in the first edge 111 of the first ring-type structure 112 is opposite to the direction of current in the second edge 113 of the second ring-type structure 114, and the first edge 111 and the second edge 113 generate negative mutual inductance. In addition, when the inductor device 100 is a single coil inductor (i.e., single loop inductor), there is no magnetic induction as generated in the 8-shaped inductor occurring at the coil of the single coil inductor. As shown in FIG. 4 and FIG. 5, disposing the first switch 122 and the second switch 124 of the connector 120 in different positions will generate positive or negative mutual inductance such that the inductor device 100 is capable of providing various inductances so as to expand the serviceable range of the inductor device 100.

Figure 6:
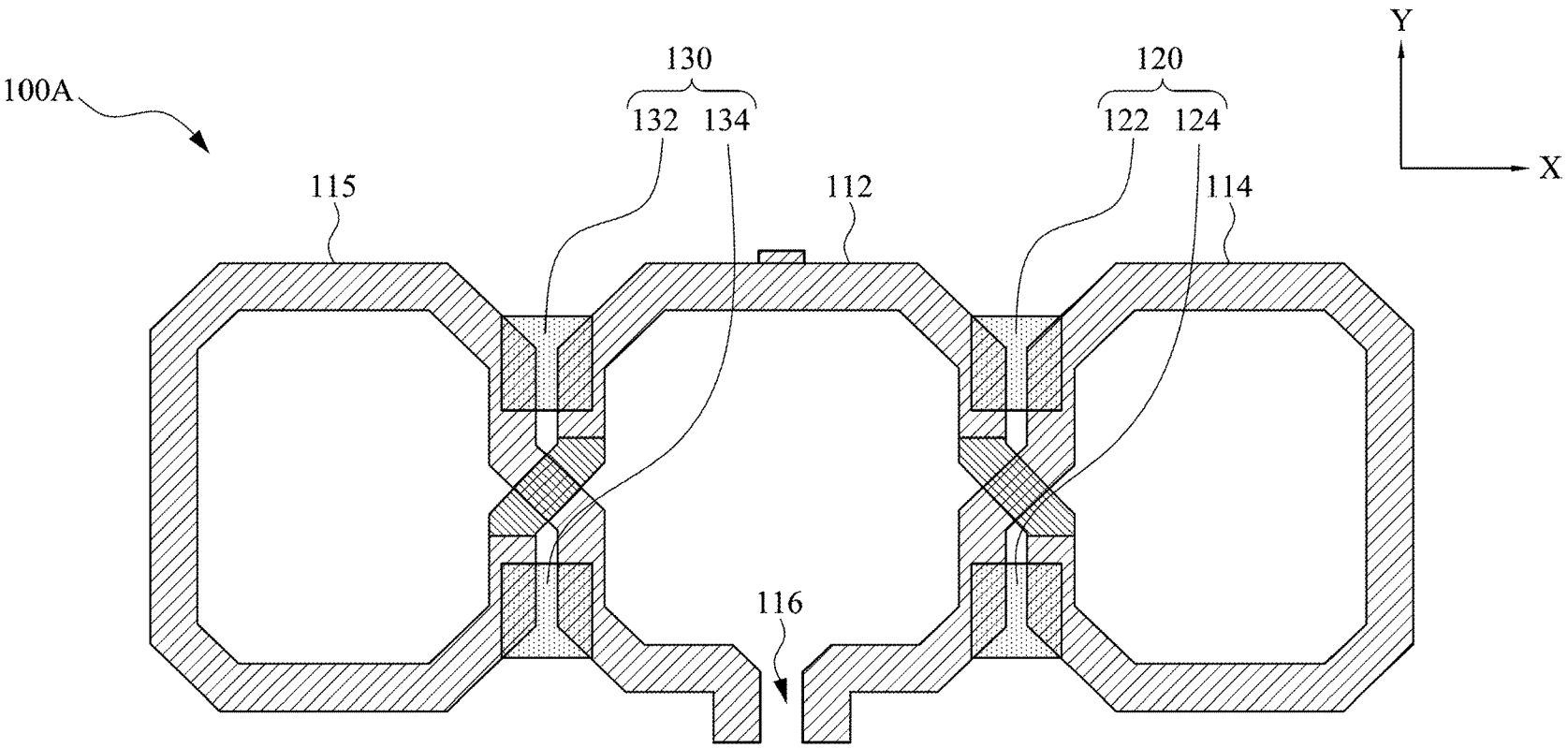
FIG. 6 is a schematic diagram of an inductor device according to embodiments of the present invention.

FIG. 6 is a schematic diagram of an inductor device according to embodiments of the present invention. Compared with the inductor device 100 as shown in FIG. 1, the inductor device 100A herein further comprises a third ring-type structure 115. The third ring-type structure 115 is coupled to the first ring-type structure 112. The connector 130 is coupled to the third ring-type structure 115, and selectively connects the first ring-type structure 112 and the third ring-type structure 115 to form single loop. It is noted that the connector 120 and the connector 130 can be in the same connection system such that the connector 120 and the connector 130 can be controlled together, or each of the connector 120 and the connector 130 can be single connection device to be controlled separately, depending on actual requirements.

In another embodiment, compared with the position of the opening 116 of the first ring-type structure 112 as shown in FIG. 1, the opening 116 of the first ring-type structure 112 herein is disposed in a first direction, and the first ring-type structure 112, the second ring-type structure 114, and the third ring-type structure 115 are disposed in a second direction. The second direction is perpendicular to the first direction. For example, the first ring-type structure 112, the second ring-type structure 114, and the third ring-type structure 115 are disposed in X direction, and the opening 116 is disposed in Y direction. On the other hand, the opening 116 is disposed at the bottom of the first ring-type structure 112 as shown in FIG. 6. However, the present disclosure is not limited to the embodiment as shown in FIG. 6, the person skilled in the art can arrange the position of the opening 116 depending on actual requirements, such as disposing the opening 116 at the top of the first ring-type structure 112 or other proper location. It is noted that the disposition relation among the connector 130, the first ring-type structure 112, and the third ring-type structure 115 as shown in FIG. 6 is similar to the disposition relation among the connector 120, the first ring-type structure 112, and the second ring-type structure 114 as shown in FIG. 1, and a detailed description regarding the disposition relation in FIG. 6 will be omitted herein for the sake of brevity.

Figure 7:
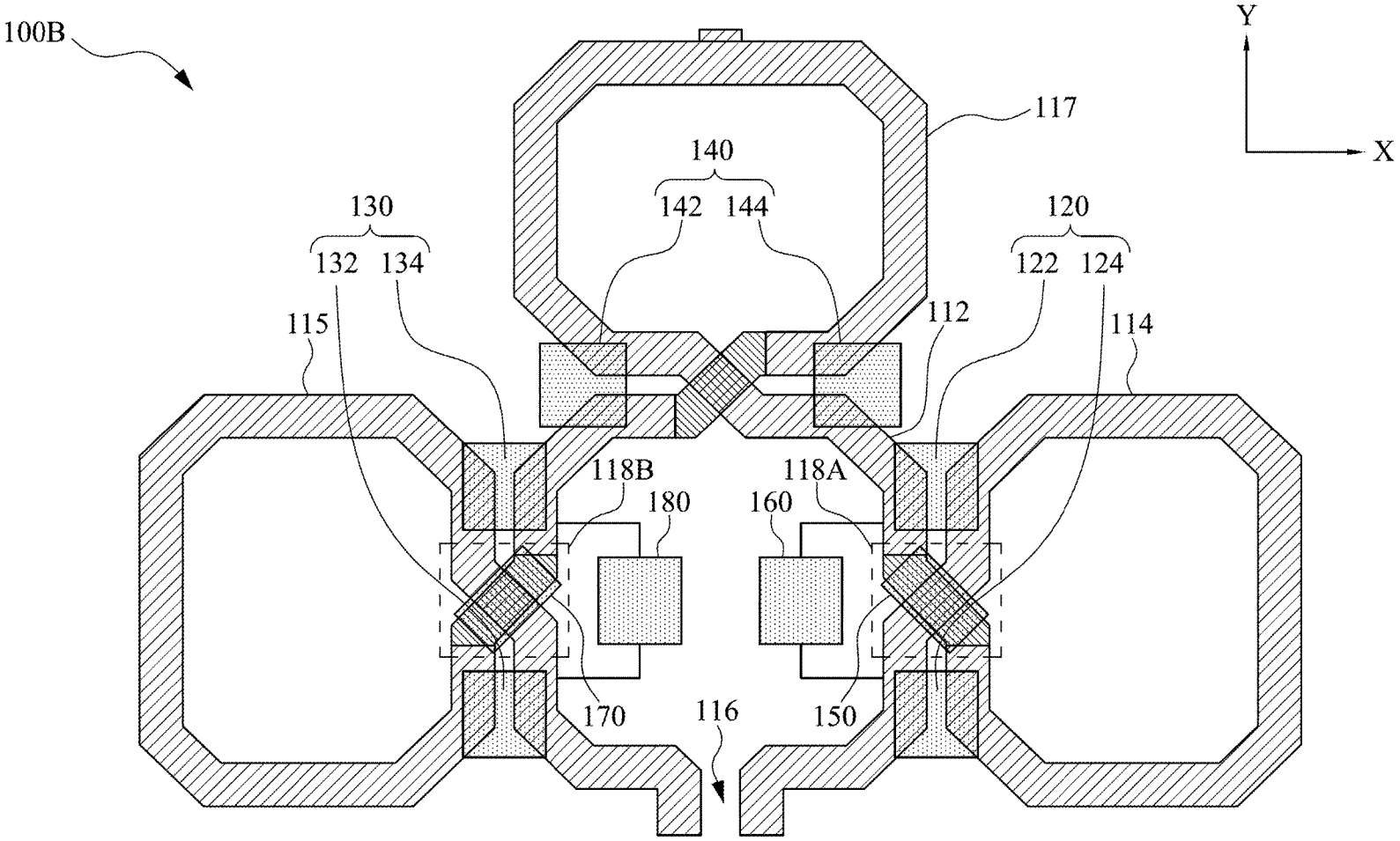
FIG. 7 is a schematic diagram of an inductor device according to embodiments of the present invention.

FIG. 7 is a schematic diagram of an inductor device according to embodiments of the present invention. Compared with the inductor device 100A in FIG. 6, the inductor device 100B herein further comprises a fourth ring-type structure 117. The fourth ring-type structure 117 is coupled to the first ring-type structure 112. In addition, the connector 140 is coupled to the fourth ring-type structure 117, and selectively connects the first ring-type structure 112 and the fourth ring-type structure 117 to form single loop.

In another embodiment, the inductor device 100B in FIG. 7 further comprises a first switch 150, a second switch 160, a third switch 170, and a fourth switch 180. The first switch 150, the first ring-type structure 112, and the second ring-type structure 114 are disposed in an interlaced manner at a first crossing point 118A. The third switch 170, the first ring-type structure 112, and the third ring-type structure 115 are disposed in an interlaced manner at a second crossing point 118B. If the first switch 150 and the third switch 170 are turned off, the second switch 160 is turned on to close the first crossing point 118A of the first ring-type structure 112, and the fourth switch 180 is turned on to close the second crossing point 118B of the first ring-type structure 112. In this condition, only the first ring-type structure 112 and the fourth ring-type structure 117 of the inductor device 100B in FIG. 7 remain working, and the inductor device 100B in FIG. 7 becomes an 8-shaped inductor.

In another embodiment, the fourth ring-type structure 117 and the opening 116 in FIG. 7 are disposed in a first direction, and the first ring-type structure 112, the second ring-type structure 114, and the third ring-type structure 115 are dispose in a second direction. The second direction is perpendicular to the first direction. For example, the fourth ring-type structure 117 and the opening 116 are disposed in Y direction, and the first ring-type structure 112, the second ring-type structure 114, and the third ring-type structure 115 are disposed in X direction. On the other hand, if the first ring-type structure 112 and the fourth ring-type structure 117 are regard as an 8-shaped inductor, the opening 116 can be disposed at the bottom of the 8-shaped inductor in FIG. 7. However, the present disclosure is not limited to the embodiment as shown in FIG. 7, the person skilled in the art can arrange the position of the opening 116 depending on actual requirements. The shape of the opening 116 can be designed as a crisscross (i.e., the structure marked 18 in the above-mentioned embodiment).

It is noted that the disposition relation among the connector 140, the first ring-type structure 112, and the fourth ring-type structure 117 as shown in FIG. 7 is similar to the disposition relation among the connector 120, the first ring-type structure 112, and the second ring-type structure 114 as shown in FIG. 1, and a detailed description regarding the disposition relation in FIG. 7 will be omitted herein for the sake of brevity. In addition, the connector 120, the connector 130, and the connector 140 can be in the same connection system such that the connector 120, the connector 130, and the connector 140 can be controlled together, or each of the connector 120, the connector 130, and the connector 140 can be single connection device to be controlled separately, depending on actual requirements.

Figure 8:
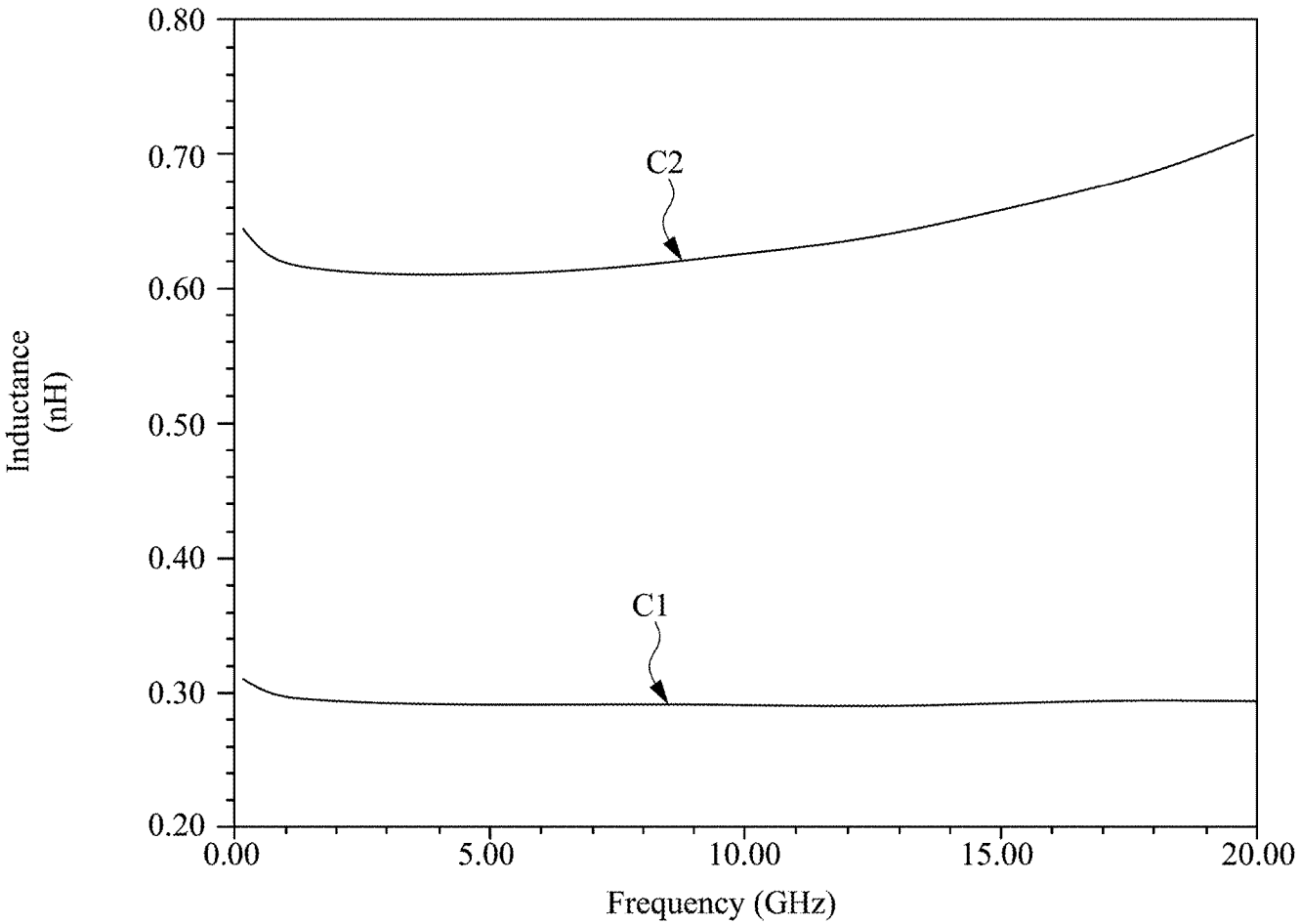
FIG. 8 is an experimental data diagram of an inductor device according to some embodiments of the present disclosure.

FIG. 8 is an experimental data diagram of an inductor device according to some embodiments of the present disclosure. This experimental data diagram is used for describing the inductance of the inductor device when the inductor device operates in different frequencies. As shown in the figure, the curve C1 represents an experimental data of an ordinary 8-shaped inductor. The curve C2 represents experimental data if the connector in the inductor device of the embodiment of the present disclosure is turned on. In other words, the connector selectively connects different ring-type structures such that the inductor device forms a ring-type inductor. The inductor device of embodiment of the present disclosure employs the connector for selectively connecting the ring-type structures such that the inductor device forms an 8-shaped inductor or a ring-type inductor. As shown in FIG. 8, since the inductance of the inductor device being an 8-shaped inductor is different from that of the inductor device being a ring-type inductor, the inductor device is capable of providing various inductances such that the serviceable range of the inductor device can be expanded.

In view of the above embodiments of the present disclosure, it is apparent that the application of the present invention has the advantages as follows. Embodiments of the present disclosure provide an inductor device to generate various inductances such that the serviceable range of the inductor device can be expanded.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An inductor device, comprising:

a conductor comprising:

a first ring-type structure; and a second ring-type structure coupled to the first ring-type structure, wherein the first ring-type structure and the second ring-type structure form an 8-shaped structure; and a connector coupled to the first ring-type structure and the second ring-type structure, and selectively connecting the first ring-type structure and the second ring-type structure such that the conductor forms a single loop;

wherein the first ring-type structure and the second ring-type structure are disposed in an interlaced manner at a crossing point, wherein the connector comprises:

a first switch coupled to the first ring-type structure and the second ring-type structure, and disposed at one side of the crossing point; and a second switch coupled to the first ring-type structure and the second ring-type structure, and disposed at another side of the crossing point;

wherein when the first switch and the second switch are turned on, a current flows from a first side of the first ring-type structure through the first switch to a first side of the second ring-type structure, from the first side of the second ring-type structure to a second side of the second ring-type structure, and from the second side of the second ring-type structure through the second switch to a second side of the first ring-type structure.

2. The inductor device of claim 1, wherein the first ring-type structure comprises:

an opening disposed in a direction, wherein the first ring-type structure and the second ring-type structure are disposed in the direction.

3. The inductor device of claim 1, wherein the first ring-type structure and the second ring-type structure respectively comprise a first polygonal structure and a second polygonal structure, wherein a first edge of the first polygonal structure is adjacent to a second edge of the second polygonal structure, wherein the first switch is coupled to one side of the first edge and one side of the second edge, and the second switch is coupled to another side of the first edge and another side of the second edge.

4. The inductor device of claim 3, wherein the crossing point is located at a center of the first edge and a center of the second edge, wherein the first switch comprises:

a first terminal coupled to a point between one side of the first edge to the center of the first edge; and a second terminal coupled to a point between one side of the second edge to the center of the second edge;

wherein the second switch comprises:

a first terminal coupled to a point between another side of the first edge to the center of the first edge; and a second terminal coupled to a point between another side of the second edge to the center of the second edge.

5. The inductor device of claim 1, wherein the conductor further comprises:

a third ring-type structure coupled to the first ring-type structure, wherein the connector is coupled to the third ring-type structure, and selectively connects the first ring-type structure and the third ring-type structure to form a single loop.

6. The inductor device of claim 5, wherein the first ring-type structure comprises:

an opening disposed in a first direction, wherein the first ring-type structure, the second ring-type structure, and the third ring-type structure are disposed in a second direction, and the second direction is perpendicular to the first direction.

7. The inductor device of claim 5, wherein the first ring-type structure and the third ring-type structure are disposed in an interlaced manner at a crossing point, wherein the connector comprises:

a third switch coupled to the first ring-type structure and the third ring-type structure, and disposed at one side of the crossing point; and a fourth switch coupled to the first ring-type structure and the third ring-type structure, and disposed at another side of the crossing point.

8. The inductor device of claim 7, wherein the first ring-type structure and the third ring-type structure respectively comprise a first polygonal structure and a second polygonal structure, wherein a first edge of the first polygonal structure is adjacent to a second edge of the second polygonal structure, wherein the third switch is coupled to one side of the first edge and one side of the second edge, and the fourth switch is coupled to another side of the first edge and another side of the second edge.

9. The inductor device of claim 8, wherein the crossing point is located at a center of the first edge and a center of the second edge, wherein the third switch comprises:

a first terminal coupled to a point between one side of the first edge to the center of the first edge; and a second terminal coupled to a point between one side of the second edge to the center of the second edge;

wherein the fourth switch comprises:

a first terminal coupled to a point between another side of the first edge to the center of the first edge; and a second terminal coupled to a point between another side of the second edge to the center of the second edge.

10. The inductor device of claim 5, wherein the conductor further comprises:

a fourth ring-type structure coupled to the first ring-type structure, wherein the connector is coupled to the fourth ring-type structure, and selectively connects the first ring-type structure and the fourth ring-type structure to form single loop.

11. The inductor device of claim 10, wherein the first ring-type structure comprises:

an opening disposed in a first direction, wherein the first ring-type structure, the second ring-type structure, and the third ring-type structure are disposed in a second direction, the fourth ring-type structure is disposed in the first direction, and the second direction is perpendicular to the first direction.

12. The inductor device of claim 10, wherein the first ring-type structure and the fourth ring-type structure are disposed in an interlaced manner at a crossing point, wherein the connector comprises:

a third switch coupled to the first ring-type structure and the fourth ring-type structure, and disposed at one side of the crossing point; and a fourth switch coupled to the first ring-type structure and the fourth ring-type structure, and disposed at another side of the crossing point.

13. The inductor device of claim 12, wherein the first ring-type structure and the fourth ring-type structure respectively comprise a first polygonal structure and a second polygonal structure, wherein a first edge of the first polygonal structure is adjacent to a second edge of the second polygonal structure, wherein the third switch is coupled to one side of the first edge and one side of the second edge, and the fourth switch is coupled to another side of the first edge and another side of the second edge.

14. The inductor device of claim 13, wherein the crossing point is located at a center of the first edge and at a center of the second edge, wherein the third switch comprises:

a first terminal coupled to a point between one side of the first edge to the center of the first edge; and a second terminal coupled to a point between one side of the second edge to the center of the second edge;

wherein the fourth switch comprises:

a first terminal coupled to a point between another side of the first edge to the center of the first edge; and a second terminal coupled to a point between another side of the second edge to the center of the second edge.

15. The inductor device of claim 10, wherein the connector is configured to turn off a connection between the second ring-type structure and the first ring-type structure, and turn off a connection between the third ring-type structure and the first ring-type structure, wherein the connector further comprises:

a third switch coupled to the first ring-type structure and the second ring-type structure in an interlaced manner at a first crossing point;

a fourth switch, wherein when the third switch is turned off, the fourth switch is turned on so as to close the first crossing point of the first ring-type structure;

a fifth switch coupled to the first ring-type structure and the third ring-type structure in an interlaced manner at a second crossing point; and a sixth switch, wherein when the fifth switch is turned off, the sixth switch is turned on so as to close the second crossing point of the first ring-type structure.

* * * * *